US010898753B2

(12) United States Patent
Jafari

(10) Patent No.: US 10,898,753 B2
(45) Date of Patent: Jan. 26, 2021

(54) TREADMILLS HAVING ADJUSTABLE SURFACE STIFFNESS

(71) Applicant: Amir Jafari, San Antonio, TX (US)

(72) Inventor: Amir Jafari, San Antonio, TX (US)

(73) Assignee: Board Of Regents, The University of Texas System, Austin, TX (US)

( * ) Notice: Subject to any disclaimer, the term of this patent is extended or adjusted under 35 U.S.C. 154(b) by 60 days.

(21) Appl. No.: 16/428,661

(22) Filed: May 31, 2019

(65) Prior Publication Data

US 2019/0366152 A1 Dec. 5, 2019

Related U.S. Application Data

(60) Provisional application No. 62/678,314, filed on May 31, 2018.

(51) Int. Cl.
*A63B 22/02* (2006.01)

(52) U.S. Cl.
CPC ..... *A63B 22/0228* (2015.10); *A63B 22/0214* (2015.10); *A63B 22/0292* (2015.10); *A63B 2225/09* (2013.01)

(58) Field of Classification Search
CPC ..... A63B 22/02–0292
See application file for complete search history.

(56) References Cited

U.S. PATENT DOCUMENTS 4,918,766 A * 4/1990 Leonaggeo, Jr. ..... A61D 11/00 119/674
5,184,988 A * 2/1993 Dunham ..... A63B 22/0023 482/51
7,241,250 B1 * 7/2007 French ..... A63B 22/0235 482/51
2004/0138030 A1 * 7/2004 Wang ..... A63B 22/0221 482/54
2004/0214693 A1 * 10/2004 Piaget ..... A63B 22/0235 482/52
2008/0318737 A1 * 12/2008 Chu ..... A63B 22/0023 482/54
2016/0144226 A1 * 5/2016 Artemiadis ..... A63B 22/0228 482/54
2016/0166870 A1 * 6/2016 Lagree ..... A63B 22/02 482/142
2016/0243397 A1 * 8/2016 Artemiadis ..... A63B 22/0292
(Continued)

OTHER PUBLICATIONS

Olds, Tim, "Modelling human locomotion: Applications to cycling", Sports Medicine, 2001, pp. 497-509, vol. 31, No. 7.
(Continued)

*Primary Examiner* — Jennifer Robertson
(74) *Attorney, Agent, or Firm* — Thomas Horstemeyer, LLP

(57) ABSTRACT

In one embodiment, an adjustable surface stiffness treadmill includes a treadmill unit, a scissor mechanism that supports the treadmill unit, a stiffness adjustment mechanism configured to adjust a vertical stiffness of the treadmill unit, and an input link having a first end and a second end, the first end being connected to the scissor mechanism and the second end being connected to the stiffness adjustment mechanism, wherein the input link translates downward vertical forces imposed upon the treadmill unit into horizontal forces imposed upon the stiffness adjustment mechanism.

20 Claims, 4 Drawing Sheets

(56) References Cited

U.S. PATENT DOCUMENTS

| | | | | |
|---|---|---|---|---|
| 2018/0345068 | A1* | 12/2018 | Beyer | A63B 22/0235 |
| 2018/0345069 | A1* | 12/2018 | Beyer | A63B 22/0015 |
| 2019/0366152 | A1* | 12/2019 | Jafari | A63B 22/0214 |

OTHER PUBLICATIONS

Chao, E. Y., et al., "Normative Data of Knee Joint Motion and Ground Reaction Forces in Adult Level Walking", Journal of Biomechanics, 1983, pp. 219-233, vol. 16, No. 3, Pergamon Press Ltd., Great Britain.

Geyer, Hartmut, et al., "Compliant leg behaviour explains basic dynamics of walking and running", Proceedings of the Royal Society B, 2006, pp. 2861-2867, vol. 273, doi: doi:10.1098/rspb.2006.3637.

Lichtwark, G.A. and A.M. Wilson, "Optimal muscle fascicle length and tendon stiffness for maximising gastrocnemius efficiency during human walking and running", Journal of Theoretical Biology, 2008, pp. 662-673, vol. 252, doi: 10.1016/j.jtbi.2008.01.018.

Ishikawa, Masaki, et al., "Muscle-tendon interaction and elastic energy usage in human walking", Journal of Applied Physiology, 2005, pp. 603-608, vol. 99, www.jap.org.

Goswami, Ambarish, "A new gait parameterization technique by means of cyclogram moments: Application to human slope walking", Gait and Posture, 1998, pp. 15-36, vol. 8.

Skidmore, Jeffrey, and Panagiotis ARTEMIADIS, "On the effect of walking surface stiffness on inter-limb coordination in human walking: toward bilaterally informed robotic gait rehabilitation", Journal of NeuroEngineering and Rehabilitation, 2016, pp. 1-11, vol. 13, No. 32, doi: 10.1186/s12984-016-0140-y.

Greene, Peter R. and Thomas A. McMahon, "Reflex Stiffness of Man's Anti-Gravity Muscles During Kneebends While Carrying Extra Weights*", Journal of Biomechanics, 1979, pp. 881-891, vol. 12, Pergamon Press Ltd., Great Britain.

Kerdok, Amy E., et al., "Energetics and mechanics of human running on surfaces of different stiffnesses", Journal of Applied Physiology, 2002, pp. 469-478, vol. 92, http://www.jap.org.

Vu, Hung Quy, et al., "Improving Energy Efficiency of Hopping Locomotion by Using a Variable Stiffness Actuator", IEEE/ASME Transactions on Mechatronics, 2016, pp. 472-486, vol. 21, No. 1, doi: 10.1109/TMECH.2015.2428274.

Grosu, Victor, et al., "Design of Smart Modular Variable Stiffness Actuators for Robotic-Assistive Devices", IEEE/ASME Transactions on Mechatronics, 2017, pp. 1777-1785, vol. 22, No. 4, doi: 10.1109/TMECH.2017.2704665.

Groothuis, Stefan S., et al., "The Variable Stiffness Actuator vsaUT-II: Mechanical Design, Modeling, and Identification", IEEE/ASME Transactions on Mechatronics, 2014, pp. 589-597, vol. 19, No. 2, doi: 10.1109/TMECH.2013.2251894.

Cestari, Manuel, et al., "An Adjustable Compliant Joint for Lower-Limb Exoskeletons", IEEE/ASME Transactions on Mechatronics, 2015, pp. 889-898, vol. 20, No. 2, doi: 10.1109/TMECH.2014.2324036.

Jafari, Amir, et al., "A Novel Intrinsically Energy Efficient Actuator With Adjustable Stiffness (AwAS)", IEEE/ASME Transactions on Mechatronics, 2013, pp. 355-365, vol. 18, No. 1, doi: 10.1109/TMECH.2011.2177098.

Jafari, Amir, et al., "A New Actuator With Adjustable Stiffness Based on a Variable Ratio Lever Mechanism", IEEE/ASME Transactions on Mechatronics, 2014, pp. 55-63, vol. 19, No. 1, doi: 10.1109/TMECH.2012.2218615.

Skidmore, Jeffrey, et al., "Variable Stiffness Treadmill (VST): System Development, Characterization, and Preliminary Experiments", IEEE/ASME Transactions on Mechatronics, 2015, pp. 1717-1724, vol. 20, No. 4, doi: 10.1109/TMECH.2014.2350456.

Vuong, Ngoc-Dung, et al., "A novel variable stiffness mechanism with linear spring characteristic for machining operations", Robotica, 2017, pp. 1627-1637, vol. 35, doi: 10.1017/S0263574716000357.

Jafari, Amir, et al., "How Design Can Affect the Energy Required to Regulate the Stiffness in Variable Stiffness Actuators", 2012 IEEE International Conference on Robotics and Automation, Minnesota, USA, 2012, pp. 2792-2797.

Jafari, Amir, et al., "Determinants for Stiffness Adjustment Mechanisms", Journal of Intelligent and Robotic Systems, 2016, pp. 435-454, vol. 82, doi: 10.1007/s10846-015-0253-8.

"Adult litegait", https://www.litegait.com/products/overview/Adult-LiteGait-Overview (accessed Aug. 19, 2019).

"Optima Human Performance System", AMTI force and motion, pp. 1-4, https://www.amti.biz/optima.aspx (accessed Aug. 19, 2019).

"Motion Capture for Biomechanics and Sports Science", VICON, pp. 1-7, https://www.vicon.com/motion-capture/biomechanics-and-sport (accessed Aug. 19, 2019).

"TrueOne 2400 | Making Metabolic Measurements Easy", Parvo Medics, p. 1, http://www.parvo.com/, (accessed Aug. 19, 2019).

Barkan, Andrew, et al., "Variable Stiffness Treadmill (VST): a Novel Tool for the Investigation of Gait", Proceedings—IEEE International Conference on Robotics and Automation, 2014, doi: 10.1109/ICRA.2014.6907266.

* cited by examiner

TREADMILLS HAVING ADJUSTABLE SURFACE STIFFNESS

CROSS-REFERENCE TO RELATED APPLICATION

This application claims priority to U.S. Provisional Application Ser. No. 62/678,314, filed May 31, 2018, which is hereby incorporated by reference herein in its entirety.

BACKGROUND

Human locomotion mechanics are characterized by various parameters. These parameters are determined by the physical properties of the human subject as well as those of the external environment. As for the subject, there are kinematics and geometrical variables, such as range of motion of the joints and leg length, as well as physiological variables, such as stiffness of the legs and their muscle-tendon units. These parameters can greatly affect the gait as well as the energy expenditure of the subject in various locomotion scenarios. These effects have been widely investigated by numerous researchers. As for the environment, there are the physical properties of the ground, such as slope, viscosity, damping, and stiffness. Less effort has been directed towards investigating the effects of physical properties of the external environment. Among these properties, the stiffness of the ground seems to be the most significant parameter that can influence the gait and metabolic cost of the subject. While ground stiffness has been numerically studied, experiments are still needed to provide important insights into the mechanics of human locomotion in different locomotion scenarios and speed, and in dealing with different surface stiffnesses.

Furthermore, it is still unclear how humans react to sudden/unexpected stiffness transitions in order to maintain their balance while walking or running. To study the effect of stiffness perturbation of the ground on the human gait, needed is a system that can quickly and accurately regulate the ground stiffness.

In addition, bilateral stiffness regulation ability would be an extremely helpful feature for studying the locomotion mechanics and energy expenditure of mobility-impaired patients who have asymmetrical gaits. Such studies could provide valuable insights into muscle coordination of the legs that are internally and bilaterally connected, which would lead to the ability to regulate the surface stiffness for each leg in an optimal manner in order to achieve better, quicker rehabilitation outcomes.

From the above discussion, it can be appreciated that it would be desirable to have a system and method with which the stiffness of a ground surface can be adjusted to different values for each leg, quickly and independently, without imposing any unwanted change into human locomotion kinematics.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have a system and method with which the stiffness of a ground surface can be adjusted to different values for each leg, quickly and independently, without imposing any unwanted change into human locomotion kinematics. Disclosed herein are examples of such systems and methods. More particularly, disclosed are treadmills that have adjustable surface stiffness. The treadmills comprise a stiffness adjustment mechanism that can be quickly and independently adjusted for each leg. In some embodiments, the stiffness adjustment mechanism can be adjusted by moving the vertical position of a pivot point of a moment arm of the adjustment mechanism.

In the following disclosure, various specific embodiments are described. It is to be understood that those embodiments are example implementations of the disclosed inventions and that alternative embodiments are possible. All such embodiments are intended to fall within the scope of this disclosure.

Described in this disclosure is the design and development of a novel treadmill having the ability to bilaterally adjust the surface stiffness in a purely vertical direction, regardless of the relative location of the person with respect to the treadmill. The stiffness adjustment mechanism of treadmill is based on an energy-efficient linear variable stiffness joint in which the stiffness is altered by moving the position of a pivot point of a moment arm between spring and force points of the mechanism. Therefore, the mechanism can regulate the stiffness from completely passive to rigid with minimum energy consumption regardless of the length of the moment arm or the stiffness of springs of the treadmill. By using strong stiffness adjustment actuators and selecting a short moment arm, the stiffness can be changed very quickly.

Figure 1:
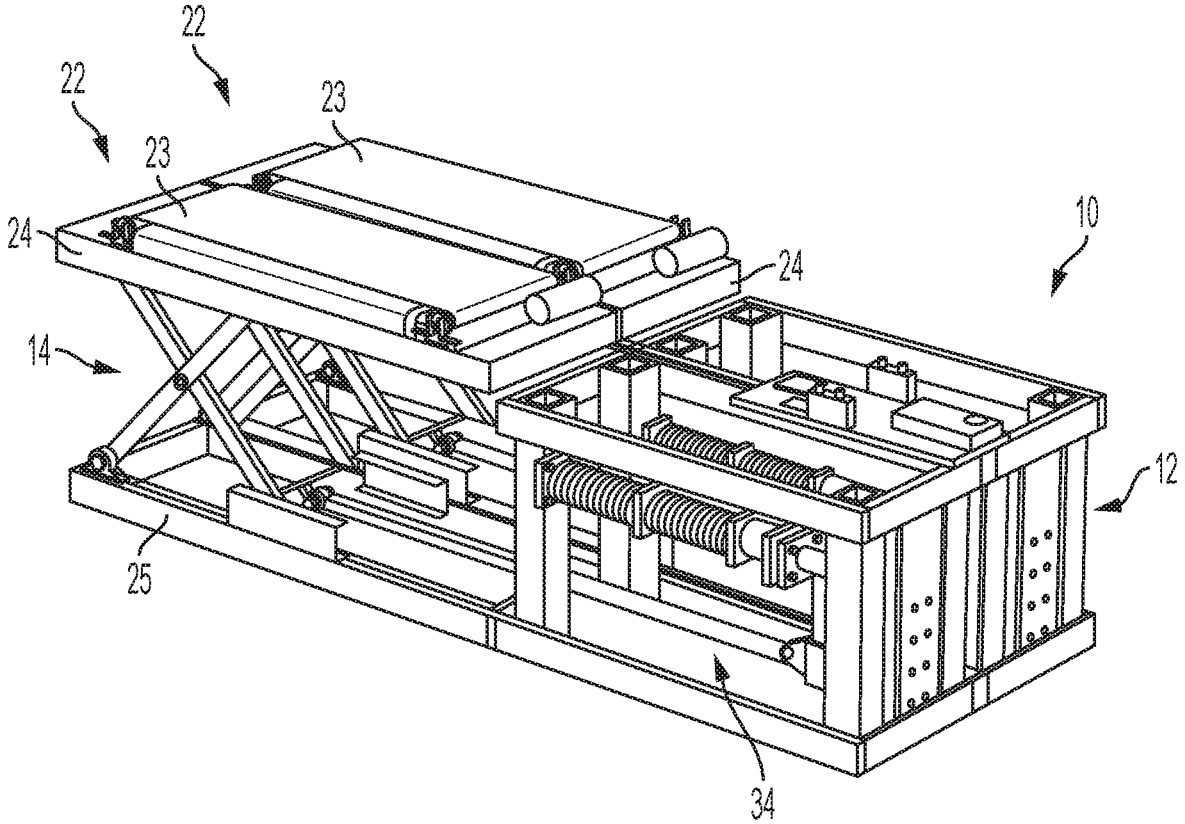
FIG. 1 is a perspective view of an embodiment of an adjustable surface stiffness treadmill.
Figure 2:
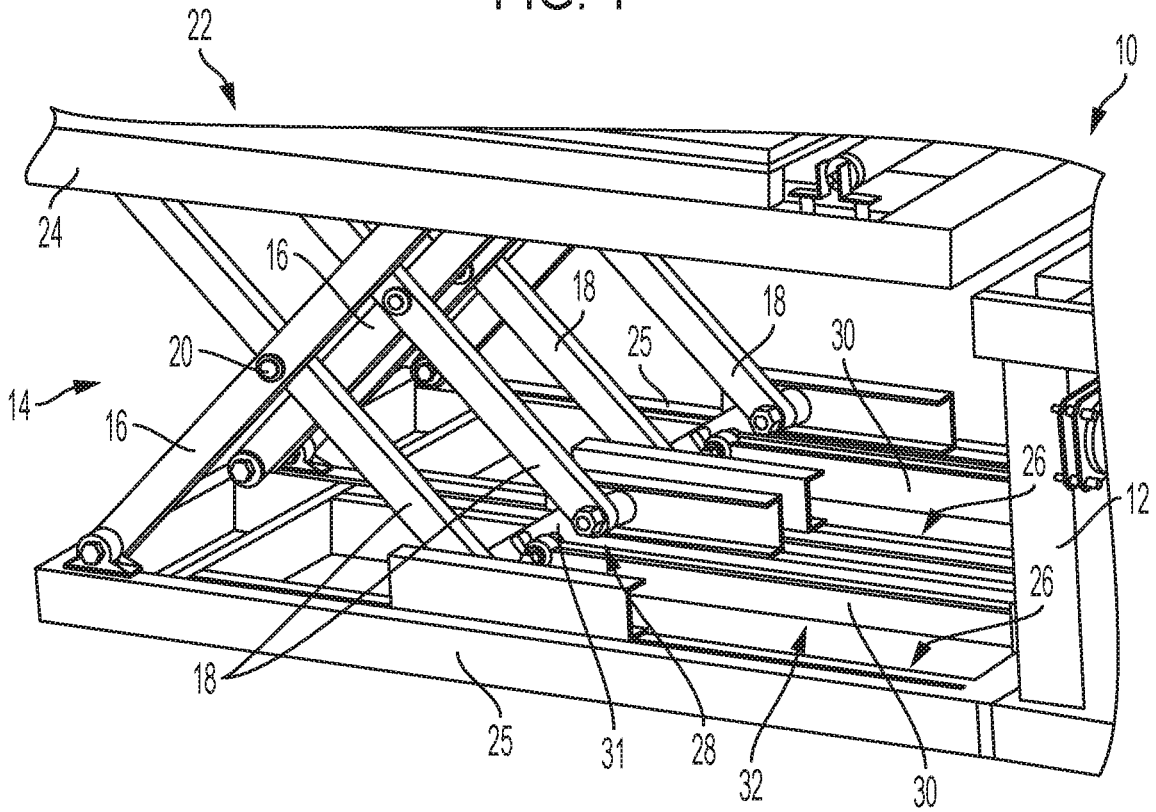
FIG. 2 is a detail perspective view of a scissor mechanism of the treadmill of FIG. 1.
Figure 3:
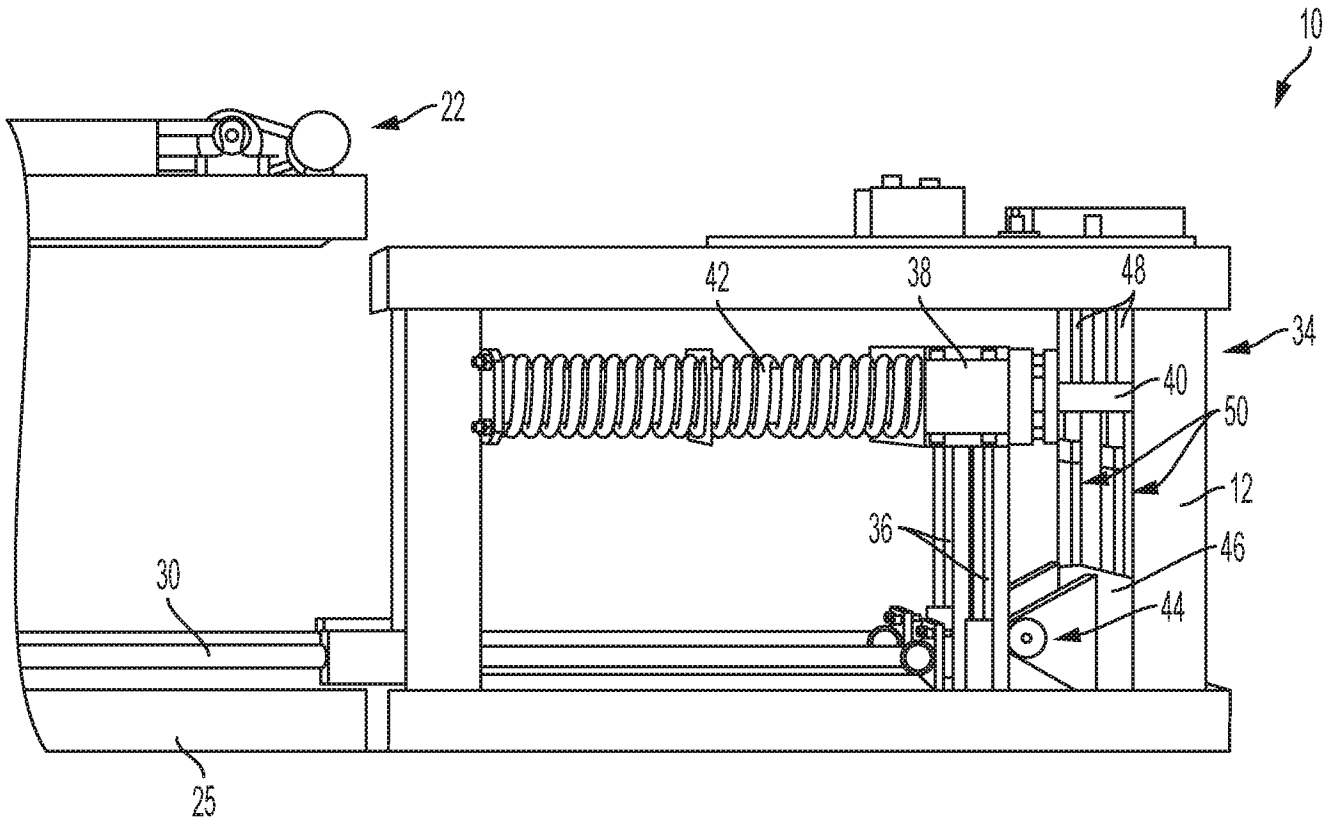
FIG. 3 is a detail side view of a stiffness adjustment mechanism of the treadmill of FIG. 1.

FIGS. 1-3 illustrate an embodiment of an adjustable surface stiffness treadmill 10. As shown most clearly in FIG. 1, the treadmill 10 comprises a stiffness mechanism frame 12 to which are connected two scissor mechanisms 14, one for each leg of a subject. With reference to FIG. 2, each scissor mechanism 14 includes two pairs of scissor arms 16 and 18 that are pivotally connected to each other at a central pivot point 20. The scissor arm pairs each support one of two independently controllable treadmill units 22. Each treadmill unit 22 comprises a rotatable, endless treadmill band 23 (FIG. 1) that can be motorized or non-motorized. Each scissor arm pair supports one lateral side of an upper treadmill frame 24 of a treadmill unit 22.

With further reference to FIG. 2, the first scissor arm 16 of each scissor arm pair is pivotally mounted at its bottom end to a rear end of a lower treadmill frame 25 and is pivotally mounted at its top end to an upper treadmill frame 24 at a medial position along the length of the upper treadmill frame. Notably, the lower treadmill frame 25 can either be independent of or part of the stiffness mechanism frame 12. The second scissor arm 18 of each scissor arm pair is pivotally mounted at its top end to a rear end of the upper treadmill frame 24 and is slidably mounted at its bottom end to a linear track 26 associated with the stiffness mechanism frame 12 with a rotary bearing 28. With such a scissor mechanism 14, sliding of the bottom end of the scissor arms 18 along their tracks 26 enables vertical displacement of the associated treadmill unit 22. Specifically, when the bottom ends of the scissor arms 18 slide along the tracks 26 in the forward direction, the scissor mechanism 14 retracts (compresses) so as to enable downward movement of the associated treadmill unit 22. When the bottom ends of the scissor arms 18 slide along the tracks 26 in the rearward direction, however, the scissor mechanism 14 extends (expands) so as to cause upward movement of the associated treadmill unit 22. Notably, the treadmill units 22 only move in the upward or downward directions without any tilting and, therefore, are always maintained in a horizontal orientation.

The bottom ends of the scissor arms 18 are each operatively connected to a rear end of an input link 30 that translates the vertical force imposed upon the treadmill unit 22 into a horizontal force. In the illustrated embodiment, each input link 30 is connected to a cross member 31 that is pivotally connected to the scissor arms 18 of each scissor mechanism 14. The input link 30 moves along a horizontal guide 32 connected to the stiffness mechanism frame 12 comprising linear bearings that constrain the link's motion to horizontal movement. In some embodiments, the horizontal guide 32 also comprises an embedded linear encoder that can measure the displacement of the input link 30. The front end of the input link 30 is connected to a stiffness adjustment mechanism 34 provided within the stiffness mechanism frame 12 with which the vertical stiffness of a treadmill unit 22, meaning the ease with which the treadmill unit can move downward in response to an applied downward force, can be adjusted.

FIG. 3 most clearly illustrates the stiffness adjustment mechanism 34. As shown in this figure, the mechanism 34 for each treadmill unit 22 includes a pair of moment arms (levers) 36 that are pivotally mounted at a bottom end to the front end of an input link 30 and are pivotally mounted at a top end to a linear bearing 38 that is mounted to and can slide along a horizontal shaft 40 that is fixedly mounted to the stiffness mechanism frame 12. Also mounted to the shaft 40 is a spring 42 against which the linear bearing 38 can be urged when a subject applies weight to the associated treadmill unit 22. In some embodiments, the moment arms 36 are connected to the input links 30 with sliding joints and are mounted to the linear bearings 38 with revolute joints.

As is also shown in FIG. 3, the stiffness adjustment mechanism 34 further includes vertically displaceable pivot points 44 to which the moment arms 36 are connected and about with they can pivot. In some embodiments, the pivot points 44 each comprise a cam follower that is mounted to a linear bearing 46 that can be displaced along a vertical shaft 48 also mounted to the stiffness mechanism frame 12 using a stiffness adjustment actuator 50. In some embodiments, the stiffness adjustment actuator 50 includes a ball screw mechanism with which the bearing 46 can be displaced. Displacement of the linear bearing 46 along the shaft 48 changes the vertical location of the pivot point 44 so as to change the vertical position of the point about which the moment arm 36 pivots. Movement of this pivot point 44 adjusts the vertical stiffness of the associated treadmill unit 22.

When one steps on one of the treadmill units 22 with his or her foot, the downward force of the subject's body weight is transmitted to the associated scissor mechanism 14, which then translates the vertical force into a horizontal force imparted to an input link 30. The input link 30, in turn, transmits the horizontal force to the bottom end of a moment arm 36, which pivots about a pivot point 44 and transmits the force to a linear bearing 38, which then transmits the force to a spring 42. As the pivot point 44 is moved higher along its vertical shaft 48 under the control of its associated stiffness adjustment actuator 50, the leverage with which the moment arm 36 acts on the spring 42 increases and the ease with which the treadmill unit 22 can be displaced downward (i.e., the vertical stiffness) decreases. As the pivot point 44 is moved lower, however, the leverage with which the moment arm 36 acts on the spring 42 decreases and the ease with which the treadmill unit 22 can be displaced downward (i.e., the vertical stiffness) increases. The vertical stiffness reaches its maximum at the point at which the pivot point 44 is generally level with its associated input link 30 (i.e., the "force point"). At that point, no or substantially no vertical displacement of the treadmill unit 22 is possible. The stiffness reaches its minimum at the point at which the pivot point 44 is generally level with its associated linear bearing 38 (i.e., the "spring point"). As will be appreciated by persons having ordinary skill in the art, the above individually applies to both treadmill units 22 and both stiffness adjustment mechanisms 34.

A prototype adjustable surface stiffness treadmill having a construction similar to that shown in FIGS. 1-3 and described above was constructed. Table 1 summarizes the physical properties of the prototype treadmill.

TABLE 1

Physical Properties of the Prototype Adjustable Surface Stiffness Treadmill

| | | | |
|---|---|---|---|
| Overall length | 3.8 m | Range of the stiffness | 0-∞ N/m |
| Overall width | 1.02 m | Time to change stiffness from minimum to maximum at no load | 0.5 sec |
| Overall height | 1.04 m | Spring stiffness | 4.8 kN/m |
| Weight | 210 kg | Maximum treadmill speed | 3.6 m/sec |
| Maximum vertical displacement | 30 cm | Maximum allowable vertical force | 2500N |

Figure 4:
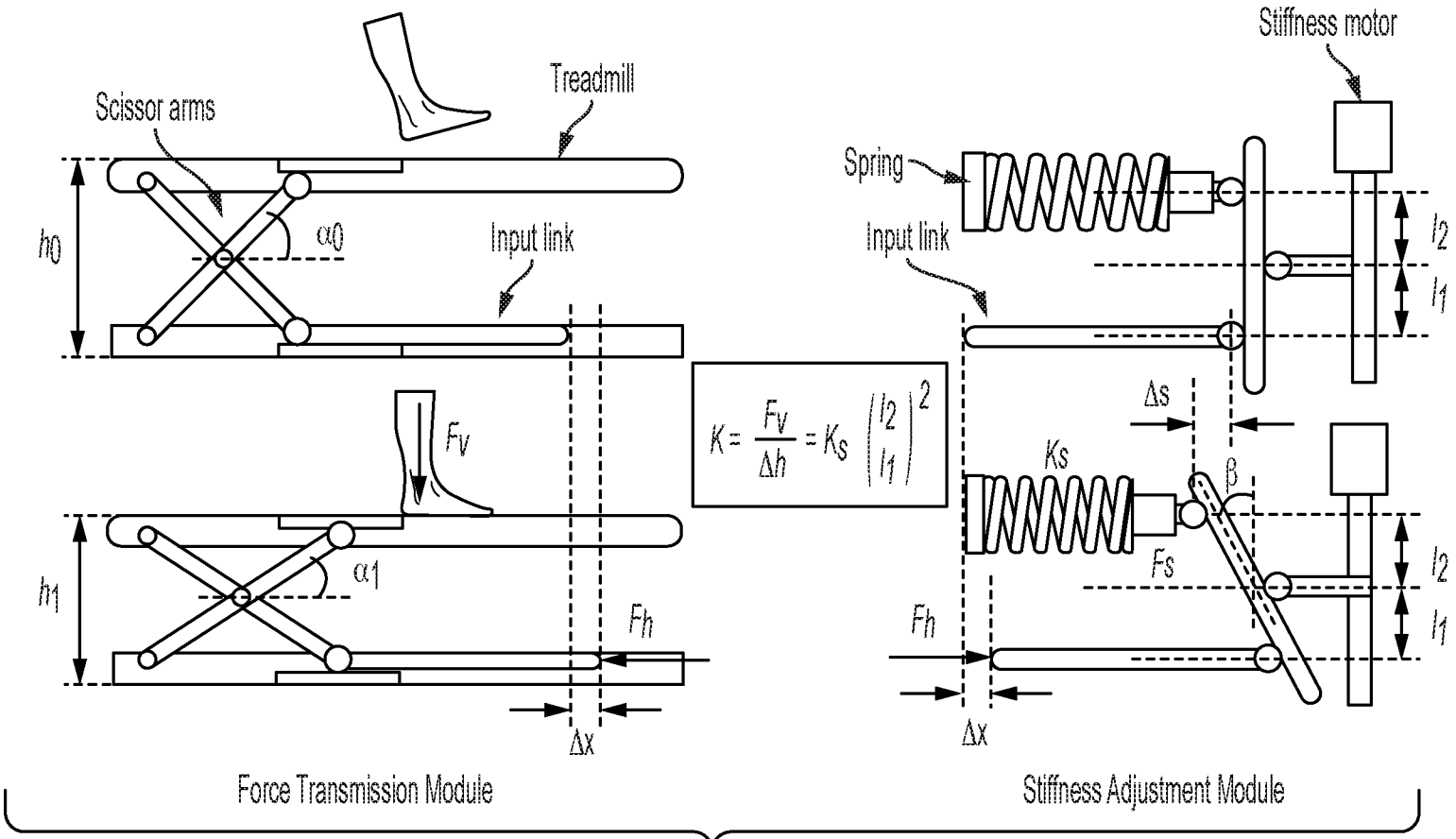
FIG. 4 is a diagram that schematically illustrates operation of the scissor mechanism and the stiffness adjustment mechanism shown in FIGS. 2 and 3, respectively.

In order to derive the stiffness formulation of the adjustable surface stiffness treadmill, one may consider the schematic of the scissor mechanism and stiffness adjustment mechanism shown in FIG. 4. Initially, the treadmill unit surface is at a height of $h_0$ from the ground. At this position, a slope of scissor arms is $\alpha_0$. Once the subject steps on the treadmill unit, the surface is displaced to a height of $h_1$ and the slope of the scissor arms becomes $\alpha_1$. The vertical displacement of the treadmill unit surface $\Delta h$ ($=h_1-h_0$) leads to horizontal displacement of the input link, $\Delta x$. This horizontal displacement is also a function of initial slope of the scissor arms $\alpha_0$. The following equation shows how the vertical displacement of the surface is related to the horizontal movement of the input link:

$$\Delta h = \frac{\cos\alpha_0 - \cos\alpha_1}{\sin\alpha_1 - \sin\alpha_0}\Delta \tag{1}$$

When $\alpha_0=45°$ and $\alpha_0-\alpha_1<10°$, one can assume that the vertical displacement of the treadmill unit surface is equal to the horizontal movement of the input link, i.e., $\Delta h=\Delta x$. Since the scissor mechanism is a passive mechanical element, meaning it does not add energy to the system, one can conclude that the input work is equal to the output work. Therefore, the vertical force applied to the treadmill unit surface $F_v$ will be equally canceled by the output horizontal force of the input link $F_h$:

$$F_h=F_v \tag{2}$$

The horizontal force acting on the input link is transmitted to the stiffness adjustment mechanism and rotates the moment arm around the pivot point by $\beta$:

$$\beta = \tan^{-1}\frac{\Delta x}{l_1} \tag{3}$$

where $l_1$ is the vertical distance between the input link and the moment arm. The rotation of the moment arm around its pivot point moves the top end of the moment arm rearward and, therefore, the spring becomes deflected by $\Delta s$:

$$\Delta s=l_2 \tan \beta \tag{4}$$

where $l_2$ is the vertical distance between the spring and the moment arm. Each spring has a stiffness of $K_s$. Therefore, the overall stiffness would be equal to $K_s$. The force due to the spring deflection, i.e., spring force $F_s$, can be found from the stiffness of the spring L and its deflection as:

$$F_s=K_s\Delta s \tag{5}$$

This force will cancel the horizontal force applied by the input link at the bottom end of the moment arm. Therefore, one can write:

$$F_s = \frac{l_1}{l_2}F_h \tag{6}$$

The stiffness of the treadmill unit surface defines how much vertical force would lead to one unit of surface deflection:

$$K = \frac{F_v}{\Delta h} \tag{7}$$

From Equations (1) and (2), one can conclude that, for small deflections, the effective stiffness of the treadmill unit surface K is equal to the effective stiffness at the input link. Therefore, the surface stiffness can then be found from Equations (3)-(6) as:

$$K = K_s\left(\frac{l_2}{l_1}\right)^2 \tag{8}$$

As the pivot point travels between the force and spring points using the stiffness adjustment actuator, the ratio between $l_1$ and $l_2$ changes from zero to infinity. As is clear from the equation, this range of stiffness can be achieved regardless of the length of the moment arm or stiffness of the spring. Therefore, even a short moment arm would result in a full range of stiffness. That said, the moment arm preferably is long enough to achieve good resolution in stiffness regulation. Another unique feature of the design is that, as Equation (8) shows, the stiffness is not a function of ft, which indicates that, for small deflections, the surface stiffness is decoupled from the surface deflection. This makes controlling the stiffness much easier as one can correctly assume the stiffness will be constant during the surface deflection.

Assuming the initial height of the surface $h_0$ is set to be around 1 m with an initial $\alpha_0=45°$, the length of the scissor arms of the scissor mechanism should be around 1.4 m. With such scissor arms, one can achieve the vertical displacement of the surface up to the considerable amount of 25 cm and yet limit the change in the angle $\alpha$ to less than 10°. Therefore, decoupling between surface stiffness and its displacement is guaranteed.

As mentioned before, the adjustable surface stiffness treadmill can theoretically change the stiffness from very soft to very rigid. The maximum stiffness that can be expected is, therefore, the structural stiffness of the system. In order to show the range of actual surface stiffness that can be realized with the treadmill, the following experiments were performed. An ATMI force plate was placed over the treadmill surface. Then, a subject with a weight around 75 kg stood on the treadmill while strapped to a LiteGait harness system.

Three markers were placed along the treadmill surface (markers A, B, and C). In addition, another marker (D) was placed at the pivot point. The markers A, B, and C form the skeleton of the treadmill surface in the sagittal plane. To measure the surface displacement, these markers were tracked by a motion capture system.

In order to measure the stiffness and its range, first the pivot point was moved to the force point (the maximum stiffness). With the use of the hydraulic system of the harness system, the weight of the person was being canceled from 0% to 100%. At each cancellation rate, the vertical force applied to the force plate (equal to the actual weight minus the canceled weight) was measured by the force plate and the surface displacement was tracked by the motion capture system. Then, using the stiffness adjustment mechanism, the pivot was moved to different points along the moment arm and the above-mentioned experiment was repeated. In total, the stiffness measurement experiments were conducted for six different points (i.e., levels of surface stiffness) by changing the position of the pivot joint from the force point all the way up to the next end, close to the spring point. The results are shown in FIG. 5.

Figure 5:
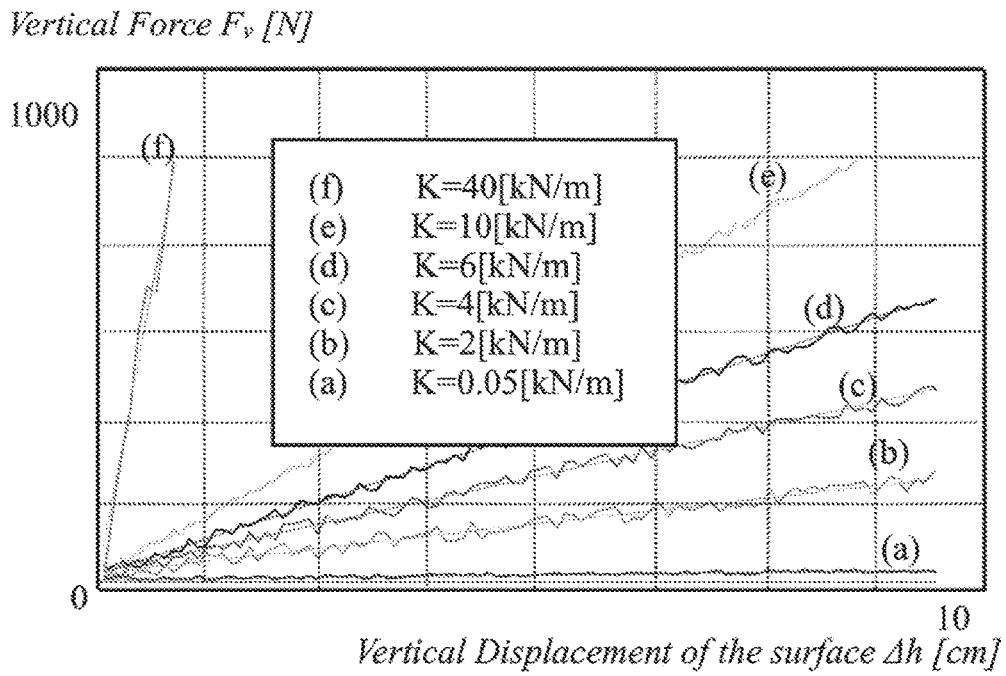
FIG. 5 is a graph that shows changes in the surface displacement $\Delta h$ as the result of canceling the weight $F_v$ of the subject. The slope of each curve represents the stiffness of the surface and the dotted lines show expected forces.

By connecting the vertical forces corresponding surface displacements for each level of stiffness, FIG. 5 reveals two important features of the adjustable surface stiffness treadmill. First, a wide range of surface stiffness (slope of each line) can be achieved. Second, the stiffness is decoupled from the displacement (each level of stiffness represents a line). So, by setting the stiffness to a certain value, it is guaranteed that it will remain constant, independent of the external force.

The expected stiffness for each position of the pivot point based on Equation (8) is also plotted in FIG. 5 (dotted lines), which shows the accuracy of the model in predicting the surface stiffness.

In a further experiment to evaluate the independence of the surface stiffness relative to the location of the subject and vertical displacement of the treadmill surface, the surface stiffness was first set to a certain compliant level. Then, a subject stood statically at three different locations on the surface: two extreme locations at each end and one at the middle of the treadmill. During the loading process at each location, the trajectories of markers A, B, and C in sagittal plane were tracked by the motion capture system.

The surface displacement remained unchanged for the three locations, which reveals that the surface stiffness of the treadmill is independent of the location of the subject while on the treadmill. This is a helpful feature when the speed of the treadmill is not exactly matched with the speed of locomotion, which would result in a relative motion between the person and the treadmill.

Figure 6:
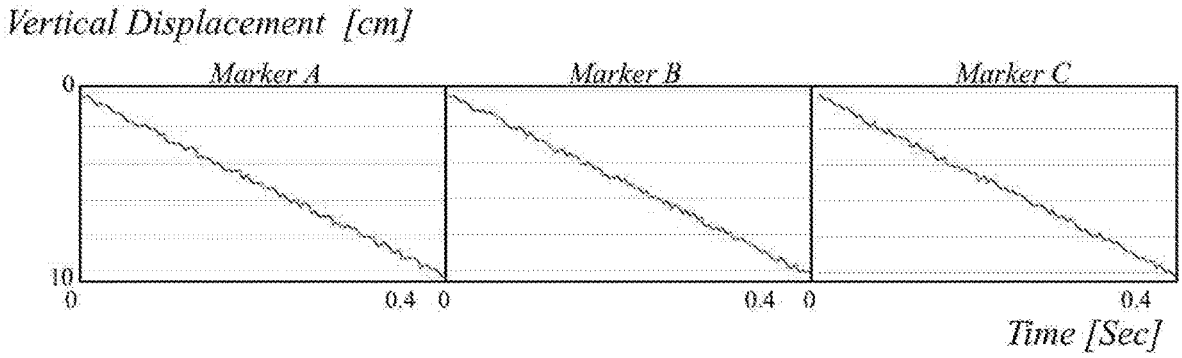
FIG. 6 is a graph that shows trajectories of Markers A, B, and C during displacement of the treadmill surface.

FIG. 6 reveals another important feature of the treadmill system. In particular, when considering the trajectories of markers A, B, and C without regard to the location of the subject, the surface displacement is purely vertical. By calculating the position of each marker at each instance of the time, it was found that the surface inclination angle remained within the range of +0.003° and 0.002°. Therefore, the displacement of the treadmill surface does not impose any unwanted kinematic constraint on the motion of the ankle joint, as is the case with other systems. This is because the scissor mechanisms of the adjustable surface stiffness treadmill restricts the surface displacement to a purely vertical one.

The above disclosure describes a novel adjustable surface stiffness treadmill that is capable of bilaterally regulating vertical stiffness of a ground surface. With the novel stiffness adjustment mechanism, one is able to adjust the stiffness within the full range (i.e., theoretically from zero to infinity) in less than 0.5 seconds. The surface compliance is decoupled from the surface vertical deflection up to 30 cm, which provides enough displacement for walking and running gaits. The treadmill's ability to quickly regulate the stiffness was experimentally evaluated. Through preliminarily experiments, it was shown that surface stiffness can greatly affect the walking gait and metabolic cost.

It is noted that the adjustable surface stiffness treadmills can include additional features in order to simulate different ground conditions, such as variable damping and adjustable slope capabilities. It is also noted that, in some embodiments, the treadmill is highly modular, which enables one to remove the treadmill units and replace them with stepmill units. With such a configuration, one can study the effects of ground stiffness on different locomotion scenarios, such as stair ascension and descension.

The invention claimed is:

1. An adjustable surface stiffness treadmill comprising:

a treadmill unit;

a scissor mechanism that supports the treadmill unit;

a stiffness adjustment mechanism configured to adjust a vertical stiffness of the treadmill unit; and an input link having a first end and a second end, the first end being connected to the scissor mechanism and the second end being connected to the stiffness adjustment mechanism, wherein the input link translates downward vertical forces imposed upon the treadmill unit into horizontal forces imposed upon the stiffness adjustment mechanism.

2. The adjustable surface stiffness treadmill of claim 1, wherein the treadmill comprises two treadmill units, one for each leg of a user.

3. The adjustable surface stiffness treadmill of claim 1, wherein the scissor mechanism comprises two scissor arms that are pivotally connected to each other.

4. The adjustable surface stiffness treadmill of claim 3, wherein the first end of the input link is operatively connected to one of the scissor arms.

5. The adjustable surface stiffness treadmill of claim 4, wherein the first end of the input link is operatively connected to a bottom end of the one scissor arm.

6. The adjustable surface stiffness treadmill of claim 4, wherein downward movement of the treadmill unit responsive to a user applying weight to the treadmill unit compresses the scissor mechanism and causes forward movement of a bottom end of the one scissor arm, which causes forward movement of the input link.

7. The adjustable surface stiffness treadmill of claim 1, wherein the stiffness adjustment mechanism comprises a moment arm having a top end and a bottom end, wherein the bottom end of the moment arm is pivotally connected to the second end of the input link.

8. The adjustable surface stiffness treadmill of claim 7, wherein the stiffness adjustment mechanism further comprises an adjustable pivot point about which the moment arm is configured to pivot.

9. The adjustable surface stiffness treadmill of claim 8, wherein the stiffness adjustment mechanism further includes a shaft and a linear bearing that is mounted on the shaft, wherein the top end of the moment arm is pivotally connected to the linear bearing and the linear bearing is movable along the shaft.

10. The adjustable surface stiffness treadmill of claim 9, wherein the stiffness adjustment mechanism further comprises a spring also mounted on the shaft that opposes the movement of the linear bearing along the shaft.

11. The adjustable surface stiffness treadmill of claim 10, wherein movement of the pivot point along the length of the moment arm away from the input link increases the leverage with which the moment arm urges the linear bearing against the spring and, therefore, decreases the vertical stiffness of the treadmill.

12. The adjustable surface stiffness treadmill of claim 11, wherein movement of the pivot point downward along the length of the moment arm toward the input link decreases the leverage with which the moment arm urges the linear bearing against the spring and, therefore, increases the vertical stiffness of the treadmill.

13. The adjustable surface stiffness treadmill of claim 12, wherein the stiffness adjustment mechanism further comprises an adjustable stiffness actuator configured to move the pivot point along the moment arm in response to a received command.

14. An adjustable surface stiffness treadmill comprising:

two treadmill units;

two scissor mechanisms, each scissor mechanism supporting one of the treadmill units and including two scissor arms that are pivotally connected to each other;

two input links, each input link having a first end and a second end, the first end of each input link being operatively connected to one of the scissor arms of one of the scissor mechanisms, wherein downward movement of the associated treadmill unit responsive to a user applying weight to the treadmill unit compresses the scissor mechanism and causes forward movement of a bottom end of the one scissor arm, which causes forward movement of the input link; and two stiffness adjustment mechanisms configured to adjust vertical stiffness of the treadmill units, each stiffness adjustment mechanism including a moment arm having a top end and a bottom end, the bottom end of each moment arm being pivotally connected to the second end of one of the input links, each stiffness adjustment mechanism further including an adjustable pivot point about which a moment arm is configured to pivot, a linear bearing mounted on a shaft to which the top end of the moment arm is pivotally connected, and a spring also mounted on the shaft that opposes movement of the linear bearing along the shaft;

wherein, for each adjustment mechanism, movement of the pivot point along the length of the moment arm away from the input link increases the leverage with which the moment arm urges the linear bearing against the spring and, therefore, decreases the vertical stiffness of the treadmill, and movement of the pivot point downward along the length of the moment arm toward the input link decreases the leverage with which the moment arm urges the linear bearing against the spring and, therefore, increases the vertical stiffness of the treadmill.

15. A method for adjusting a surface stiffness of a treadmill, the method comprising:

enabling a treadmill unit of the treadmill to move downward using a scissor mechanism that supports the treadmill unit in response to a downward vertical force applied by a user;

moving an input link of the treadmill forward with the scissor mechanism as the scissor mechanism is compressed by the treadmill unit, the input link translating the downward vertical force into a horizontal force; and imposing the horizontal force upon a stiffness adjustment mechanism of the treadmill with the input link, the stiffness adjustment mechanism providing resistance to movement of the input link, compression of the scissor mechanism, and downward movement of the treadmill unit.

16. The method of claim 15, wherein imposing the horizontal force comprises imposing the horizontal force upon a bottom end of a moment arm of the stiffness adjustment mechanism that is pivotally connected to the input link.

17. The method of claim 15, wherein a top end of the moment arm is pivotally connected to a linear bearing mounted to a shaft of the stiffness adjustment mechanism, wherein the shaft supports a spring that opposes movement of the linear bearing along the shaft.

18. The method of claim 17, wherein the moment arm pivots about an adjustable pivot point of the stiffness adjustment mechanism.

19. The method of claim 18, further comprising adjusting a position of the pivot point along a length of the moment arm to adjust the surface stiffness of the treadmill unit.

20. The method of claim 19, wherein adjusting a position of the pivot point comprises adjusting the position using an adjustable stiffness actuator configured to move the pivot point along the moment arm in response to a received command.

* * * * *